United States Patent [19]

Sakaguchi et al.

[11] Patent Number: 4,599,296

[45] Date of Patent: Jul. 8, 1986

[54] PROCESS FOR FORMING IMAGE

[75] Inventors: Yukihiko Sakaguchi; Toshiaki Aono; Shinsaku Fujita, all of Kanagawa, Japan

[73] Assignee: Fuji Photo Film Co., Ltd., Kanagawa, Japan

[21] Appl. No.: 595,006

[22] Filed: Mar. 29, 1984

[30] Foreign Application Priority Data

Mar. 30, 1983 [JP] Japan ..... 58-54165

[51] Int. Cl.[4] ..... G03C 1/40; G03C 5/54

[52] U.S. Cl. ..... 430/203; 430/218; 430/351; 430/617; 430/619

[58] Field of Search ..... 430/203, 223, 218, 617, 430/619, 351

[56] References Cited

U.S. PATENT DOCUMENTS 3,955,982 5/1976 Van Allan et al. ..... 430/619
4,430,415 2/1984 Acho et al. ..... 430/353
4,500,626 2/1985 Naito et al. ..... 430/203

FOREIGN PATENT DOCUMENTS 0076492 4/1983 European Pat. Off. ..... 430/203

OTHER PUBLICATIONS

"Aldonamides . . . ", Humphlett et al., *Research Disclosure* No. 12021, 4/1974, pp. 14–16.

*Primary Examiner*—Richard L. Schilling

*Attorney, Agent, or Firm*—Sughrue, Mion, Zinn, Macpeak, and Seas

[57] ABSTRACT

A process for forming an image which comprises heating a light-sensitive material comprising a support having thereon at least a light-sensitive silver halide, a binder and a dye releasing redox compound which is reductive to the light-sensitive silver halide and capable of releasing a hydrophilic dye upon reaction with the light-sensitive silver halide by heating, after imagewise exposure or simultaneously with imagewise exposure, in a substantially water-free condition in the presence of a compound represented by the formula (A):

(A)

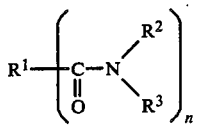

wherein $R^1$ represents a hydrogen atom or a monovalent or divalent aliphatic group; $R^2$ and $R^3$, which may be the same or different from each other, each represents a hydrogen atom, an aliphatic group or an aromatic group; $R^1$ and $R^2$ may be taken together to form a heterocyclic ring; $R^2$ and $R^3$ may be taken together to form a heterocyclic ring; and n represents 1 or 2, to imagewise form a mobile dye is disclosed.

22 Claims, No Drawings

PROCESS FOR FORMING IMAGE

FIELD OF THE INVENTION

This invention relates to a novel process for forming a dye image by heating in a substantially water-free condition.

Furthermore, the present invention relates to a novel light-sensitive material containing a dye releasing redox compound which releases a hydrophilic dye upon reaction with a light-sensitive silver halide by heating in a substantially water-free condition.

More particularly, the present invention relates to a novel process for obtaining a dye image by transferring a dye released by heating into a dye fixing layer.

BACKGROUND OF THE INVENTION

A photographic process utilizing a silver halide has heretofore been widely used due to its excellent photographic characteristics such as sensitivity, control of gradation, etc., as compared with other photographic processes, such as an electrophotographic process or a diazo photographic process. In recent years, with respect to image formation processes for light-sensitive materials using a silver halide, a technique capable of easily and quickly forming an image, for example, a dry development process such as a process of using heat, has been developed for the conventional wet development process using a developing solution.

Heat-developable light-sensitive materials are known in the art. Heat-developable light-sensitive materials and processes suitable therefor are disclosed in, for example, Shashin Kogaku no Kiso, Corona Co., Ltd., pages 553–555, *Eizo Joho,* April 1978, page 40, *Nebletts Handbook of Photography and Reprography,* 7th Ed., Van Nostrand Reinhold Company, pages 32–33, U.S. Pat. Nos. 3,152,904, 3,301,678, 3,392,020 and 3,457,075, British Pat. Nos. 1,131,108 and 1,167,777, and *Research Disclosure,* June 1978, pages 9–15 (RD-17029).

Many processes for obtaining color images using a dry process have been proposed.

With respect to processes for forming color images by the reaction of an oxidation product of a developing agent with a coupler, use of a p-phenylenediamine type reducing agent and a phenolic coupler or an active methylene coupler as disclosed in U.S. Pat. No. 3,531,286, a p-aminophenol type reducing agent as disclosed in U.S. Pat. No. 3,761,270, a sulfonamidophenol type reducing agent as disclosed in Belgian Pat. No. 802,519 and *Research Disclosure,* pages 31 and 32 (Sept., 1975) and the combination of a sulfonamidophenol type reducing agent and a 4-equivalent coupler as disclosed in U.S. Pat. No. 4,021,240 has been proposed.

These processes, however, are disadvantageous in that turbid color images are formed since a reduced silver image and a color image are simultaneously formed in the exposed area after heat-development. In order to eliminate this disadvantage, a process which comprises removing a silver image by liquid processing and a process which comprises transferring only the dye to another layer, for example, a sheet having an image receiving layer have been proposed. However, the latter process is not desirable because it is not easy to transfer only the dye as opposed to unreacted substances.

Another process which comprises introducing a nitrogen containing heterocyclic group into a dye, forming a silver salt and releasing a dye by heat-development is described in *Research Disclosure,* RD-16966, pages 54–58 (May, 1978). With this process, clear images cannot be obtained because it is difficult to control the release of dyes from the non-exposed areas, and thus it is not a generally applicable process.

Further, process for forming a positive-working color image by a silver dye bleach process utilizing heat as well as useful dyes therefor and methods for bleaching are disclosed in, for example, *Research Disclosure,* RD-14433, pages 30–32 (April, 1976), ibid., RD-15227, pages 14–15 (Dec., 1976) and U.S. Pat. No. 4,235,957.

However, these processes require an additional step and an additional material for accelerating a bleaching of the dyes, for example, a step of heating with a superposed sheet with an activating agent, and also have the disadvantage that the resulting color images are gradually reduced and bleached by free silver which is also present during storage for a long period of time.

Moreover, a process for forming a color image using a leuco dye has been disclosed in, for example, U.S. Pat. Nos. 3,985,565 and 4,022,617. However, this process involves a difficulty in incorporation of the leuco dye in the photographic material in a stable manner and causes gradual coloration during storage.

In addition, all of the above-described conventional processes generally require a long period of time for development to obtain images of high fog and low density.

SUMMARY OF THE INVENTION

The present invention provides a novel process for forming a color image by heating in a substantially water-free condition, overcoming the problems encountered in the conventional materials.

Accordingly, an object of the present invention is to provide a novel process for forming a color image by transferring a mobile hydrophilic dye released upon heating into a dye fixing layer in a substantially water-free condition to obtain a dye image.

Another object of the present invention is to provide an easy process for accelerating the formation of a dye image.

Still another object of the present invention is to provide a light-sensitive material which can give a dye image having a sufficiently high maximum density by heating for a short period of time.

Yet another object of the present invention is to provide an easy process for obtaining a distinct dye image by a simple and easy procedure.

These objects of the present invention are accomplished by a process comprising heating a light-sensitive material comprising a support having thereon at least a light-sensitive silver halide, a binder, and a dye releasing redox compound which is reductive to the light-sensitive silver halide and capable of releasing a hydrophilic dye upon reaction with the light-sensitive silver halide by heating, after imagewise exposure or simultaneously with imagewise exposure, in a substantially water-free condition in the presence of a compound represented by the formula (A):

(A)

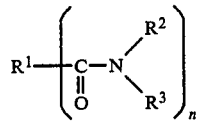

wherein $R^1$ represents a hydrogen atom or an n-valent aliphatic group; $R^2$ and $R^3$, which may be the same or different from each other, each represents a hydrogen atom, an aliphatic group or an aromatic group; $R^1$ and $R^2$ may be taken together to form a heterocyclic ring; $R^2$ and $R^3$ may be taken together to form a heterocyclic ring; and n represents 1 or 2, to imagewise form a mobile dye.

DETAILED DESCRIPTION OF THE INVENTION

The compound represented by the formula (A) is described in detail below.

In a preferred embodiment, $R^1$ represents a monovalent or divalent, saturated hydrocarbon group having 1 to 60 carbon atoms, more preferably 1 to 40 carbon atoms, a monovalent or divalent unsaturated hydrocarbon group having 2 to 60 carbon atoms, more preferably 2 to 40 carbon atoms, or a monovalent or divalent cyclic hydrocarbon group having 3 to 60 carbon atoms, more preferably 3 to 40 carbon atoms. These hydrocarbon groups may be substituted with an alkoxy group, an acyloxy group, a carboalkoxy group, a carboxyl group, a hydroxyl group, an epoxy group or a halogen atom, preferably chlorine, bromine or fluorine.

Preferred examples of $R^1$ are monovalent saturated hydrocarbon groups having 1 to 40 carbon atoms represented by the formula: $C_kH_{2k+1}$— wherein k is an integer of 1 to 40, and include, for example, a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group, an octadecyl group, etc.

Preferred examples of $R^1$ are divalent saturated hydrocarbon groups having 1 to 40 carbon atoms represented by the formula —$C_kH_{2k}$— wherein k is an integer of 1 to 40, and include, for example, —$CH_2$—, -(-$CH_2$)$_2$, -(-$CH_2$)$_4$, --$CH_2$)$_7$, --$CH_2$)$_8$, -(-$CH_2$)$_{10}$,

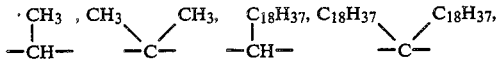

etc.

Preferred examples of $R^1$ are monovalent unsaturated hydrocarbon groups having 2 to 40 carbon atoms represented by the formula $C_kH_{2k-1}$— wherein k is an integer of 2 to 40, and include, for example, a group of $C_8H_{17}CH{=}CH(CH_2)_7$—, etc.

Preferred examples of $R^1$ are divalent unsaturated hydrocarbon groups having 2 to 40 carbon atoms represented by the formula —$(C_kH_{2k-3})$— wherein k is an integer of 2 to 40, and include, for example groups of —CH=CH—,

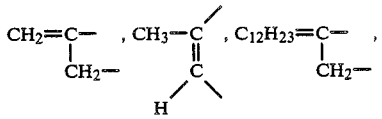

etc.

Preferred examples of $R^1$ are monovalent cyclic hydrocarbon groups having 3 to 40 carbon atoms represented by the formula $C_kH_{2k-l}$, wherein k is an integer of 3 to 40 and l is 3, 5 or 7, and include, for example, a cyclopentyl group, a cyclohexyl group, a cycloheptyl group, a cyclododecyl group, a cyclohexenyl group, an adamantyl group, etc.

Preferred examples of $R^1$ are divalent cyclic hydrocarbon groups having 3 to 40 carbon atoms represented by the formula —$(C_kH_{2k-j})$—, wherein k is an integer of 3 to 40 and j is 2, 4 or 6, and include, for example, groups of

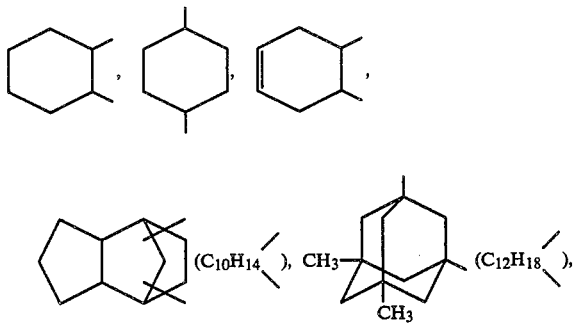

etc.

Additional preferred examples of $R^1$ include the saturated hydrocarbon groups substituted by an alkoxy group having 1 to 40 carbon atoms, preferably 1 to 20 carbon atoms, e.g., a methoxy group, an ethoxy group, a butoxy group, a hexadenoxy group, etc.; an acyloxy group having 1 to 40 carbon atoms, preferably 1 to 20 carbon atoms, e.g., a fatty acid ester group having 1 to 20 carbon atoms, an aromatic carboxylic acid ester group having 6 to 20 carbon atoms, etc.; a carboalkoxy group having 2 to 40 carbon atoms, a carboxyl group, a hydroxyl group, an epoxy group, a chlorine atom or a fluorine atom.

In the formula (A), $R^2$ and $R^3$, which may be the same or different, each preferably represents a hydrogen atom, a saturated hydrocarbon group having 1 to 60 carbon atoms, more preferably 1 to 40 carbon atoms, an unsaturated hydrocarbon group having 2 to 60 carbon atoms, more preferably 2 to 40 carbon atoms, a cyclic hydrocarbon group having 3 to 60 carbon atoms, preferably 3 to 40 carbon atoms, or an aromatic hydrocarbon group having 6 to 60 carbon atoms, preferably 6 to 40 carbon atoms. These groups may be substituted by an alkoxy group, an acyloxy group, a carboalkoxy group, a carboxyl group, a hydroxyl group, an epoxy group or a halogen atom, e.g., chlorine, bromine or fluorine.

More preferably, $R^2$ and $R^3$ each represents a hydrogen atom, a saturated hydrocarbon group having 1 to 40 carbon atoms represented by the formula $C_kH_{2k+1}$—, wherein k is an integer of 1 to 40, e.g., a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group, an octadecyl group, etc.; an unsaturated hydrocarbon group having 2 to 40 carbon atoms represented by the formula $C_kH_{2k-1}$—, e.g., a group $C_8H_{17}CH{=}CH(CH_2)_8$—, etc.; and a cyclic hydrocarbon group having 3 to 40 carbon atoms which is preferably represented by the formula $C_kH_{2-l}$—, wherein k is an integer of 3 to 40 and l is 3, 5 or 7, e.g., a cyclopentyl group, a cyclohexyl group, a cycloheptyl group, a cyclododecyl group, a cyclohexenyl group, an adamantyl group, etc.

Additioonal preferred examples for $R^2$ or $R^3$ include those saturated hydrocarbon groups which are substituted by an alkoxy group having 1 to 40 carbon atoms, preferably 1 to 20 carbon atoms, e.g., a methoxy group, an ethoxy group, a butoxy group, a hexadenoxy group, etc.; an acyloxy group having 1 to 40 carbon atoms, preferably 1 to 20 carbon atoms, e.g., a fatty acid ester group having 1 to 20 carbon atoms, an aromatic carboxylic acid ester group having 6 to 20 carbon atoms, etc.; a carboalkoxy group having 2 to 40 carbon atoms, a carboxyl group, a hydroxyl group, an epoxy group, a chlorine atom or a fluorine atom.

In the formula (A), the nitrogen-containing heterocyclic group formed by $R^1$ and $R^2$ or $R^2$ and $R^3$ preferably includes a 5-membered or 6-membered ring which may contain 1 to 2 nitrogen atoms or oxygen atoms in addition to carbon atoms, e.g., oxazole, pyrazole, imidazole, pyrimidine, oxazine, pyridine, pyrrolidine, imidazolidine, etc.

Specific examples of the compounds of the present invention are illustrated below, but it should be understood that the present invention is not limited thereto.

$C_7H_{15}CON(CH_3)_2$ (1)

$C_7H_{15}CON(C_2H_5)_2$ (2)

$C_{11}H_{23}CON(CH_3)_2$ (3)

$C_{11}H_{23}CON(C_2H_5)_2$ (4)

$C_8H_{17}CH{=}CH(CH_2)_7CON(CH_3)_2$ (5)

$C_8H_{17}CH{=}CH(CH_2)_{11}CONH_2$ (6)

(7)

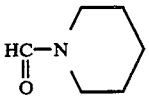

(8)

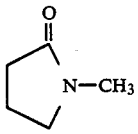

(9)

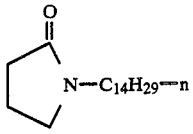

(10)

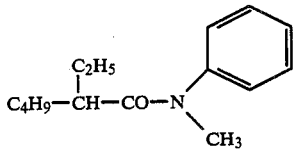

(11)

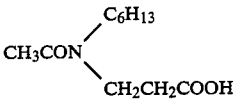

(12)

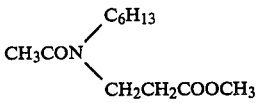

-continued (13)

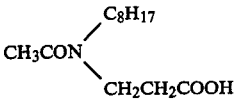

(14)

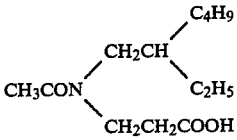

(15)

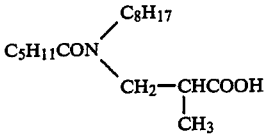

$(C_2H_5)_2N{-}CO(CH_2)_8CON(C_2H_5)_2$ (16)

(17)

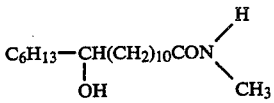

(18)

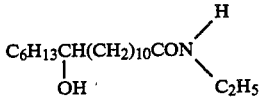

(19)

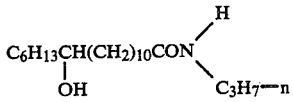

(20)

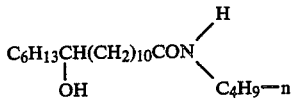

(21)

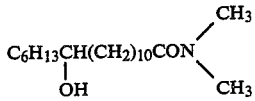

(22)

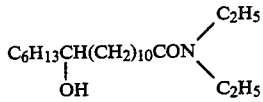

(23)

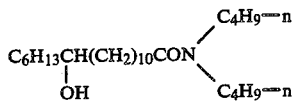

(24)

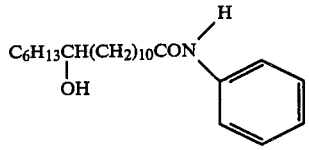

(25)

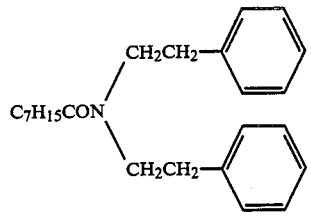

-continued

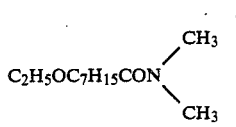

(26)

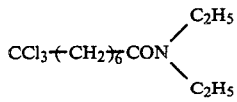

(27)

$C_{11}H_{23}CON(C_2H_4Cl)_2$ (28)

$C_{11}H_{23}CON(C_2H_4OCH_3)_2$ (29)

The compounds of the formula (A) can easily be synthesized by the reaction between the corresponding carboxylic acid and amine, the reaction between the corresponding carboxylic acid chloride and amine, or the reaction between the corresponding carboxylic acid anhydride and amine, and the like. With regard to these reactions, reference can be made to S. R. Sandler and W. Karo, *Organic Functional Group Preparations,* Academic Press (1968), pages 269–300 and literatures cited therein, V. Migrdichian, *Organic Synthesis,* Vol. 1, Reinhold Publishing Corp. (1957), pages 367–394 and literatures cited therein, H. Bertsch, H. Reinheckel, G. Czichocki, Fette, Seifen, *Anstrichmittel,* 68 (1966), pages 817–24, *Chem. Zent.,* (1967), pages 37–2494, T. H. Applewhite, J. S. Binder, *J. Am. Oil Chem. Soc.,* 44 (1967), pages 423–424, and Yamate, Shikibu, Shibosan Kagaku (revised and supplemented edition), Koshobo (1974), pages 81–95.

Synthesis of N-butyl-12-hydroxystearic acid amide is shown below as an example of syntheses.

PREPARATION EXAMPLE 50 g of methyl 12-hydroxystearate, 300 ml of methanol and 20 ml of a 28% methanol solution of sodium methoxide were mixed, and 50 ml of n-butylamine was added thereto. The resulting mixture was heat-refluxed for 6.5 hours. After cooling, the reaction mixture was poured into dilute hydrochloric acid, and the precipitated crystals were filtered to obtain 47 g of N-butyl-12-hydroxystearic acid amide having a melting point of 100°–102° C.

Other compounds of the present invention hereinbefore described can be synthesized in the same manner as described above, or by the processes in the above-described literatures as well as the literatures cited in *Yushi Kagaku Binran* (revised 2nd Ed.), Maruzen (1971), page 142, Tables 2.116 and 2.117 and R. B. Wagner, H. D. Zook, *Synthetic Organic Chemistry,* John Wiley (1953), pages 578–583.

The compounds of the present invention can be used alone or in the mixtures thereof and dispersed in an aqueous solution of a hydrophilic colloid using a dispersing aid. The methods for dispersing are described in, for example, U.S. Pat. Nos. 2,304,939, 2,322,027, 2,801,170, 2,801,171 and 2,949,360.

The compounds of the present invention can be used in combination with high boiling organic solvents, such as phthalic acid alkyl esters (e.g., dibutyl phthalate and dioctyl phthalate), phosphoric acid esters (e.g., diphenyl phosphate, triphenyl phosphate, tricresyl phosphate and dioctylbutyl phosphate), citric acid esters (e.g., tributyl acetylcitrate), benzoic acid esters (e.g., octyl benzoate), fatty acid esters (e.g., dibutoxyethyl succinate and dioctyl acetate) and the like.

The compound of the present invention is usually dispersed in an aqueous solution of hydrophilic colloid in combination with the dye releasing redox compound and a low boiling organic solvent having a boiling point of about 30° to 160° C. using a dispersing aid. If necessary, other photographic additives can be dispersed simultaneously.

Examples of the low boiling organic solvent having a boiling point of about 30° to 160° C. include lower alkyl acetates, such as ethyl acetate and butyl acetate, ethyl propionate, sec-butyl alcohol, methyl isobutyl ketone, β-ethoxyethyl acetate, methyl cellosolve acetate and cyclohexanone.

Examples of the dispersing aid which can usually be used include anionic surfactants (e.g., sodium alkylbenzenesulfonate, sodium dioctylsulfosuccinate, sodium dodecylsulfonate, sodium alkylnaphthalenesulfonate and Fischer type couplers), amphoteric surfactants (e.g., N-tetradecyl-N,N-dipolyethylene-α-betaine) and nonionic surfactants (e.g., sorbitan monolaurate). In addition, the surfactants appearing in this specification can also be used as the dispersing aid.

A dispersion of the compound of the present invention containing the dye releasing redox compound can be added to any one or both of an emulsion layer, such as a silver halide emulsion layer, and an intermediate layer in the heat-developable light-sensitive material.

Further, a dispersion of the compound of the present invention which does not contain the dye releasing redox compound can be added to a hydrophilic colloid layer, e.g., a surface protective layer, an intermediate layer, etc., an emulsion layer, e.g., a silver halide emulsion layer, etc., of the heat-developable light-sensitive material, or a layer containing a mordant for a fixing material as described hereinafter, or other layers.

Incorporation of the compound of the present invention into a layer of the light-sensitive layer can be carried out by a known process, such as the process disclosed in U.S. Pat. No. 2,322,027.

The compound of the present invention is usually used in an amount of 0.01 to 20 times, preferably 0.01 to 5 times, the weight of the dye releasing redox compound.

In cases where the dispersion of the compound of the present invention does not contain the dye releasing redox compound, the compound is preferably used in an amount of 0.001 to 5 g/m$^2$.

The term "dye image" as used herein includes both the multicolor and monocolor dye images. The monocolor dye image includes a monocolor image obtained by mixing at least two dyes.

According to the image formation process of the present invention, a silver image and a mobile dye image corresponding to the silver image can be formed simultaneously by merely heating after imagewise exposure. In other words, when the heat-developable light-sensitive material is imagewise exposed and developed by heating in a substantially water-free condition, an oxidation-reduction reaction occurs between a light-sensitive silver halide and a reducing dye releasing redox compound by the action of the exposed silver halide as a catalyst, and a silver image is formed in the exposed area. At this stage, the dye releasing redox compound is oxidized by silver halide into the corresponding oxidation product. As a result, a hydrophilic mobile dye is released and the silver image and mobile dye are formed in the exposed area. The presence of a dye releasing aid at this stage accelerates the above-described reaction. By transferring the thus formed mobile dye into, for example, a dye fixing layer, the desired dye image can be obtained.

The above explanation has been made to the case of using a negative-working emulsion. In the case of using an autopositive-working emulsion, the same is applicable with the exception that the silver image and mobile dye are obtained in the unexposed area.

The oxidation-reduction reaction between the light-sensitive silver halide and the dye releasing redox compound and the subsequent dye releasing reaction according to the present invention are characterized in that they occur at high temperatures and also in a substantially water-free condition. The term "high temperatures" as used herein means temperatures of 80° C. or more. The term "substantially water-free condition" means a condition which is in an equilibrium state to water in air but is no addition of water from the outside of the system. Such a condition is described in T. H. James edt., *The Theory of the Photographic Process,* 4th Ed., Macmillan, page 374. Showing a sufficient reactivity even in a substantially water-free dry condition can be confirmed by the fact that the reactivity of a test sample does not drop even if it is vacuum dried at $10^{-3}$ mmHg for one day.

It has been believed that the dye releasing reaction takes place by the attack of a nucleophilic reagent and such a reaction is usually carried out in a liquid having a pH of at least 10. Therefore, it is unexpected that high reactivity can be obtained at high temperatures and also in a substantially water-free condition. Further, the dye releasing redox compound of the present invention can undergo an oxidation-reduction reaction with a silver halide without an aid of a so-called auxiliary developing agent. This is an unexpected result which cannot be anticipated from the knowledge of the conventional wet development system which is carried out at temperatures near ordinary temperature.

The above-described reactions proceeds smoothly to produce a high image density particularly when an organic silver salt oxidizing agent, e.g., silver benzotriazole, is present in the system. It is, therefore, particularly preferred in the present invention that such an organic silver salt oxidizing agent is used in combination.

The dye releasing redox compound which releases a hydrophilic diffusible dye used in the present invention is a compound described in European Patent Application (OPI) No. 76,492 as a dye releasing compound and is represented by the following general formula:

$$R_a\text{-}SO_2\text{-}D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Application (OPI) No. 76,492.

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application B No. 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same color or in order to represent black color.

The dye releasing redox compounds are suitably used in a range from 10 mg/m$^2$ to 15 g/m$^2$ and preferably in a range from 20 mg/m$^2$ to 10 g/m$^2$ in a total.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.01 μm to 10 μm and more preferably from 0.001 μm to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,453, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be containd in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a suupersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

It is advantageous to use a compound represented by the general formula described below in the heat-developable color photographic material in order to accelerate development and accelerate release of a dye.

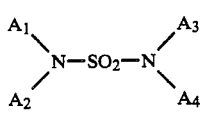

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by image-wise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if necessary, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The present invention is further illustrated by the following Examples, but they are not to be construed as limiting the present invention.

EXAMPLE 1

A method for preparing a silver iodobromide emulsion is described below.

40 g of gelatin and 26 g of potassium bromide were dissolved in 3,000 ml of water, and the resulting solution was stirred while maintaining the temperature at 50° C. To the solution was then added a solution of 34 g of silver nitrate dissolved in 200 ml of water over a period of 10 minutes.

Thereafter, a solution of 3.3 g of potassium iodide in 100 ml of water was added thereto over a period of 2 minutes.

The pH of the thus prepared silver iodobromide emulsion was controlled to cause precipitation, and excess salts were removed. The emulsion was adjusted to a pH of 6.0 to obtain 400 g of the silver iodobromide emulsion.

A method of preparing a gelatin dispersion of a dye releasing redox compound containing the compound of the present invention is described below.

5 g of Dye Releasing Redox Compound (1) of the formula:

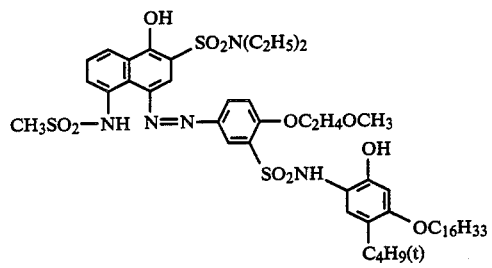

(1)

0.5 g of sodium 2-ethylhexylsuccinate sulfonate as a surfactant and 5 g of Compound (1) of the present invention were dissolved in 30 ml of ethyl acetate by heating at about 60° C. to form a uniform solution. This solution was mixed with 100 g of a 10% aqueous solution of limetreated gelatin under stirring and then dispersed by use of a homogenizer at 10,000 rpm for 10 minutes.

The resulting dispersion is designated a dispersion of the dye releasing redox compound containing the compound of the present invention.

A method of preparing a light-sensitive coating is described below.

(a) Light-sensitive silver iodobromide emulsion 25 g
(b) Dispersion of dye releasing redox compound containing the compound of the present invention 33 g
(c) 10% Ethanol solution of guanidinetrichloroacetic acid 15 ml (d) 5% Aqueous solution of the compound of the formula: 5 ml

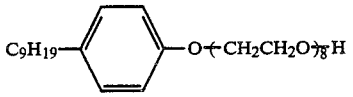

(e) 10% Aqueous solution of dimethylsulfamide 4 ml
(f) Water 5 ml

The above components (a) to (f) were mixed and dissolved, and the solution was coated on a polyethylene terephthalate film in a wet thickness of 30 μm. A 3% aqueous solution of gelatin was coated thereon as a protective layer in a wet thickness of 30 μm. this coated sample is designated "Sample (A)".

As a comparative sample, Sample (B) was prepared in the same manner as described above except that the compound of the present invention in the dispersion of the dye releasing redox compound was replaced by Comparative Compound (1) as described below.

Comparative Compound (1)

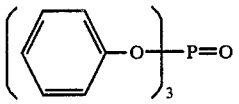

These samples were dried and then imagewise exposed at 2,000 lux for 10 seconds using a tungsten lamp. Then, the samples were uniformly heated for 10 seconds or 20 seconds on a heating block which had been heated at 130° C.

A method of preparing a dye fixing material is described below.

10 g of poly(methyl acrylate-co-N,N,N-trimethyl-N-vinylbenzylammonium chloride) (the molar ratio of methyl acrylate to vinylbenzylammonium chloride was 1:1) was dissolved in 200 ml of water, and the solution was uniformly mixed with 100 g of a 10% aqueous solution of lime-treated gelatin. The resulting mixture was uniformly coated on a paper support on which titanium dioxide-dispersed polyethylene had been laminated in a wet thickness of 90 μm. This sample was dried and then used as a dye fixing material having a mordant layer.

The dye fixing material was dipped in water, and the above heated light-sensitive material was superposed on the dye fixing material in such a manner that the coated layers of the two materials were in contact with each other. Thereafter, the superposed product was heated for 6 seconds on a heating block heated at 80° C. The dye fixing material was peeled apart from the light-sensitive material, whereby a negative-working magenta color image was formed on the dye fixing material. The maximum density ($D_{max}$) and the fog density ($D_{min}$) of the negative image to green light were measured by use of a Macbeth reflection densitometer (RD-519). The results obtained are shown in Table 1.

TABLE 1

| | Heating Conditions | | | |
|---|---|---|---|---|
| | 130° C., 10 Sec. | | 130° C., 20 Sec. | |
| Sample | $D_{max}$ | $D_{min}$ | $D_{max}$ | $D_{min}$ |
| (A) | 1.92 | 0.21 | 2.36 | 0.32 |

TABLE 1-continued

| | Heating Conditions | | | |
|---|---|---|---|---|
| | 130° C., 10 Sec. | | 130° C., 20 Sec. | |
| Sample | $D_{max}$ | $D_{min}$ | $D_{max}$ | $D_{min}$ |
| (B) | 0.53 | 0.15 | 1.47 | 0.19 |

It can be seen from Table 1 that the sufficient maximum density can be obtained by heating for a shorter period of time in the presence of the compound of the present invention than that required in the presence of the comparative compound.

EXAMPLE 2

In what follows, an example in which silver benzotriazole, one of organic silver salt oxidizing agents, is used is described.

A silver benzotriazole emulsion was prepared as follows.

28 g of gelatin and 13.2 g of benzotriazole were dissolved in 3,000 ml of water, and the solution was stirred while maintaining the temperature at 40° C. A solution of 17 g of silver nitrate in 100 ml of water was added thereto over a period of 2 minutes.

The pH of the resulting silver benzotriazole emulsion was controlled to cause precipitation, and excess salts were removed. Thereafter, the emulsion was adjusted to a pH of 6.0 to obtain 400 g of the silver benzotriazole emulsion.

Using the silver benzotriazole emulsion, the following light-sensitive coating was prepared.

(a) Silver iodobromide emulsion of Example 1 200 g
(b) Silver benzotriazole emulsion 10 g
(c) Dispersion (prepared in the same manner as in Example 1 except that Compound (1) of the present invention was replaced by each compound shown in Table 2) 33 g
(d) 10% Ethanol solution of guanidinetrichloracetic acid 16 ml
(e) 5% Aqueous solution of compound of the formula 5 ml

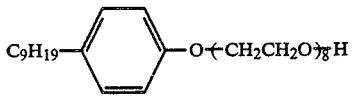

(f) 10% Aqueous solution of dimethylsulfamide 4 ml
(g) Water 5 ml

The above components (a) to (g) were mixed and dissolved, and the resulting solution was coated on a polyethylene terephthalate film in a wet thickness of 30 μm. A 3% aqueous solution of gelatin was coated thereon in a wet thickness of 30 μm to form a protective layer.

Further, Samples (C) to (H) were prepared in the same manner as described for the preparation of the above coating except for using a dispersion of a dye releasing redox compound containing the compound of the present invention shown in Table 2 below.

Sample (I) was prepared using Comparative Compound (2) of the following formula in place of the compound of the present invention:

TABLE 2

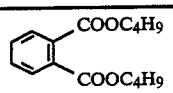

| Sample | Compound of the Present Inventtion | Dye Releasing Redox Compound |
|---|---|---|
| (C) | (2) | (2)* |
| (D) | (4) | (2) |
| (E) | (5) | (2) |
| (F) | (7) | (2) |
| (G) | (13) | (2) |
| (H) | (23) | (2) |
| (I) | Comparative Compound (2) | (2) |

*Note:
The Dye Releasing Redox Compound (2) herein used has the following formula:

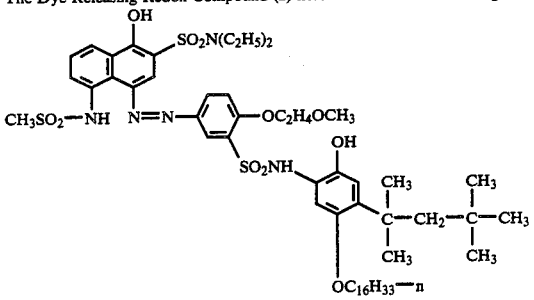

Samples (C) to (I) were exposed, heated and transferred in the same manner as in Example 1, and the reflective density of the resulting image to green light was measured in the same manner as in Example 1. The results obtained are shown in Table 3.

TABLE 3

| | Heating Conditions | | | |
|---|---|---|---|---|
| | 130° C., 10 Sec. | | 130° C., 20 Sec. | |
| Sample | $D_{max}$ | $D_{min}$ | $D_{max}$ | $D_{min}$ |
| (C) | 1.63 | 0.20 | 2.25 | 0.28 |
| (D) | 1.84 | 0.29 | 2.38 | 0.36 |
| (E) | 1.51 | 0.19 | 2.24 | 0.37 |
| (F) | 1.40 | 0.21 | 2.17 | 0.28 |
| (G) | 1.77 | 0.25 | 2.35 | 0.33 |
| (H) | 1.62 | 0.21 | 2.22 | 0.30 |
| (I) | 0.78 | 0.12 | 1.44 | 0.18 |

It can be seen from Table 3 that the sufficient maximum density can be obtained by heating for a short period of time by the use of the compound of the present invention even in a system using a silver benzotriazole emulsion.

EXAMPLE 3

Samples (J) to (O) were prepared in the same manner as described for the preparation of Samples (C) to (H) in Example 2 except for using the dye releasing redox compounds shown in Table 4. Samples (K), (M) and (O) were prepared using Comparative Compound (1) in place of the compound of the present invention.

TABLE 4

| Sample | Compound of the Present Invention | Dye Releasing Redox Compound (color) |
|---|---|---|
| (J) | (3) | (3)* (yellow) |
| (K) | Comparative Compound (1) | (3) (yellow) |
| (L) | (3) | (4)* (magenta) |
| (M) | Comparative Compound (1) | (4) (magenta) |
| (N) | (3) | (5)* (cyan) |

TABLE 4-continued

| Sample | Compound of the Present Invention | Dye Releasing Redox Compound (color) |
|---|---|---|
| (O) | Comparative Compound (1) | (5) (cyan) |

*Note:
Dye Releasing Redox Compounds (3) to (5) are compounds having the following formulae:

(3)

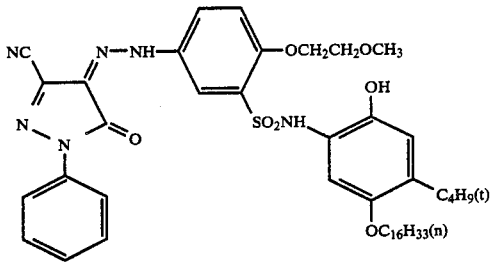

(4)

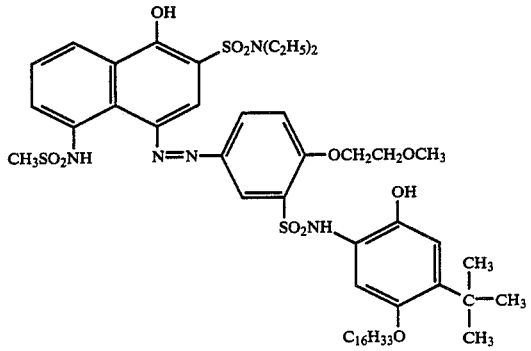

(5)

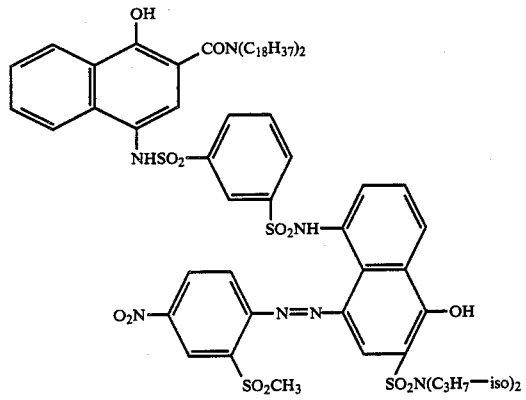

Samples (J) to (O) were exposed, heated and transferred in the same manner as in Example 1, and the reflective density of the resulting image to blue light [Samples (J) and (K)], green light [Samples (L) and (M)], or red light [Samples (N) and (O)] was measured in the same manner as in Example 1. The results obtained are shown in Table 5.

TABLE 5

| | Heating Conditions | | | |
|---|---|---|---|---|
| | 130° C., 10 Sec. | | 130° C., 20 Sec. | |
| Sample | $D_{max}$ | $D_{min}$ | $D_{max}$ | $D_{min}$ |
| (J) | 1.52 | 0.17 | 2.26 | 0.21 |
| (K) | 0.99 | 0.11 | 1.53 | 0.19 |
| (L) | 1.63 | 0.15 | 2.34 | 0.25 |
| (M) | 0.79 | 0.10 | 1.46 | 0.24 |
| (N) | 1.72 | 0.28 | 2.39 | 0.41 |
| (O) | 0.84 | 0.16 | 1.38 | 0.23 |

It can be seen from Table 5 that the sufficient maximum density can be obtained by heating for a short time by the use of the compound of the present invention even in cases of using Dye Releasing Redox Compounds (3) to (5).

While the invention has been described in detail and with reference to specific embodiments thereof, it will be apparent to one skilled in the art that various changes and modifications can be made therein without departing from the spirit and scope thereof.

What is claimed is:

1. A process for forming an image which comprises heating a light-sensitive material comprising a light-sensitive silver halide, a binder and a dye releasing redox compound which is reductive to the light-sensitive silver halide and capable of releasing a hydrophilic dye upon reaction with the light-sensitive silver halide by heating to a temperature of about 80° C. to about 250° C., after imagewise exposure or simultaneously with imagewise exposure, in a substantially water-free condition in the presence of a compound represented by the formula (A) which does not decompose during heating:

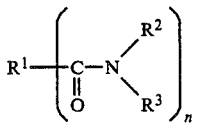

(A)

wherein $R^1$ represents an unsubstituted monovalent or divalent aliphatic group; $R^2$ and $R^3$, which may be the same or different from each other, each represents a hydrogen atom, an aliphatic group or an aromatic group; and the total number of carbon atoms for $R^1$, $R^2$ and $R^3$ is 9 or more; and n represents 1 or 2, to imagewise form a mobile dye and transfer the thus formed mobile dye into another layer.

2. A process as claimed in claim 1, wherein $R^1$ in the formula (A) is a monovalent or divalent saturated hydrocarbon group having 1 to 60 carbon atoms, a monovalent or divalent unsaturated hydrocarbon group having 2 to 60 carbon atoms or a monovalent or divalent cyclic hydrocarbon having 3 to 60 carbon atoms.

3. A process as claimed in claim 2, wherein $R^1$ in the formula (A) is a monovalent saturated hydrocarbon group having 1 to 40 carbon atoms, a divalent saturated hydrocarbon group having 1 to 40 carbon atoms, a monovalent unsaturated hydrocarbon group having 2 to 40 carbon atoms, a divalent unsaturated hydrocarbon group having 2 to 40 carbon atoms, a monovalent cyclic hydrocarbon group having 3 to 40 carbon atoms or a divalent cyclic hydrocarbon group having 3 to 40 carbon atoms.

4. A process as claimed in claim 2, wherein the monovalent or divalent saturated hydrocarbon group has 1 to 60 carbon atoms.

5. A process as claimed in claim 3, wherein the monovalent saturated hydrocarbon group having 1 to 40 carbon atoms is a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group or an octadecyl group.

6. A process as claimed in claim 3, wherein the divalent saturated hydrocarbon group having 1 to 40 carbon atoms is a group $—CH_2—$, $-(CH_2)_2-$, $-(CH_2)_4-$, $—(CH_2)_7$, $--CH_2)_8$, $—CH_2)_{10}$,

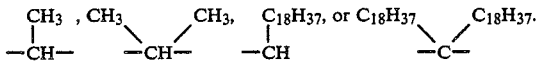

7. A process as claimed in claim 3, wherein the monovalent unsaturated hydrocarbon group having 1 to 40 carbon atoms is a group $C_8H_{17}CH{=}CH(CH_2)_7—$.

8. A process as claimed in claim 3, wherein the divalent unsaturated hydrocarbon group having 2 to 40 carbon atoms is a group $—CH{=}CH—$,

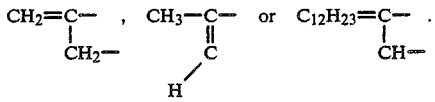

9. A process as claimed in claim 3, wherein the monovalent cyclic hydrocarbon group having 3 to 40 carbon atoms is a cyclopentyl group, a cyclohexyl group, a cycloheptyl group, a cyclododecyl group, a cyclohexenyl group or an adamantyl group.

10. A process as claimed in claim 3, wherein the divalent cyclic hydrocarbon group having 3 to 40 carbon atoms is a group

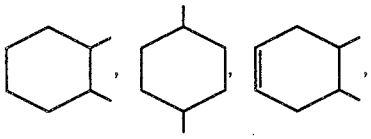

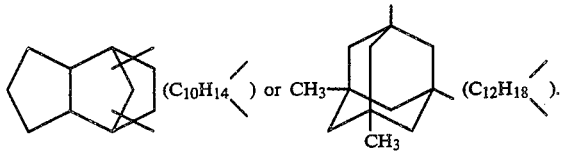

11. A process as claimed in claim 1, wherein $R^2$ and $R^3$, which may be the same or different from each other, each represents a hydrogen atom, a saturated hydrocarbon group having 1 to 60 carbon atoms, an unsaturated hydrocarbon group having 2 to 60 carbon atoms, a cyclic hydrocarbon group having 3 to 60 carbon atoms, or an aromatic hydrocarbon group having 6 to 60 carbon atoms.

12. A process as claimed in claim 11, wherein $R^2$ and $R^3$, which may be the same or different from each other, each represents a hydrogen atom, a saturated hydrocarbon group having 1 to 40 carbon atoms, an unsaturated hydrocarbon group having 2 to 40 carbon atoms, a cyclic hydrocarbon group having 3 to 40 carbon atoms, or an aromatic hydrocarbon group having 6 to 40 carbon atoms.

13. A process as claimed in claim 12, wherein the saturated hydrocarbon group having 1 to 40 carbon atoms is a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group or an octadecyl group.

14. A process as claimed in claim 12, wherein the unsaturated hydrocarbon group having 2 to 40 carbon atoms is a group $C_8H_{17}CH{=}CH(CH_2)_8{-}$.

15. A process as claimed in claim 12, wherein the cyclic hydrocarbon group having 3 to 40 carbon atoms is a cyclopentyl group, a cyclohexyl group, a cycloheptyl group, a cyclododecyl group, a cyclohexenyl group or an adamantyl group.

16. A process as claimed in claim 11, wherein the monovalent or divalent saturated hydrocarbon group has 1 to 60 carbon atoms.

17. A process as claimed in claim 1, wherein said light-sensitive material further comprises a dye fixing layer.

18. A process as claimed in claim 1, wherein the compound of the formula (A) is used in an amount of 0.01 to 20 times the weight of the dye releasing redox compound.

19. A process as claimed in claim 18, wherein the compound of the formula (A) is used in an amount of 0.01 to 5 times the weight of the dye releasing redox compound.

20. A process as claimed in claim 1, wherein the heating is conducted at a temperature of at least 80° C.

21. A process as claimed in claim 1, wherein the substantially water-free condition is a condition which is in equilibrium state to water in air but is no addition of water from the outside of the system.

22. A process as claimed in claim 1, wherein the compound of formula (A) is a liquid at room temperature.

* * * * *